United States Patent [19]

Burton

[11] 4,121,743

[45] Oct. 24, 1978

[54] BOW TRANSPORT HOLSTER

[76] Inventor: Glenn A. Burton, 1103 Biscayne Dr., Little Rock, Ark. 72207

[21] Appl. No.: 808,155

[22] Filed: Jun. 20, 1977

[51] Int. Cl.[2] ..... F41C 33/00

[52] U.S. Cl. ..... 224/1 R; 124/88; 224/5 R; 224/25 R

[58] Field of Search ..... 224/0.5, 1 R, 1 A, 1 B, 224/2 D, 2 E, 2 F, 5 R, 5 A, 25 R; 124/23 R, 41 R, 88, 89; 248/220.2, 222.1, 223.4, 224.2, 224.3, 225.1

[56] References Cited

U.S. PATENT DOCUMENTS

| | | | |
|---|---|---|---|
| 2,220,633 | 11/1940 | Albino | 224/5 A |
| 2,424,302 | 7/1947 | Brickey | 224/2 D |
| 2,789,742 | 4/1957 | DeSalvo | 224/3 |
| 3,168,971 | 2/1965 | Goertzen | 224/1 R |
| 3,343,735 | 9/1967 | Breeding et al. | 224/5 A |
| 3,377,999 | 4/1968 | Reynolds | 124/88 X |
| 3,840,944 | 10/1974 | Gresley | 248/223.4 X |
| 3,963,156 | 6/1976 | Perrin | 224/1 R |

*Primary Examiner*—Trygve M. Blix
*Assistant Examiner*—Winston H. Douglas
*Attorney, Agent, or Firm*—Hill, Gross, Simpson, Van Santen, Steadman, Chiara & Simpson

[57] ABSTRACT

A transport holster for archery bows includes a holster member having loops for attachment to an archer's belt, the holster member supporting a female interlock member which cooperates with a male interlock member attached to a bow at the balance point of the bow to removably attach the bow to the holster member. The interlock members are angled such as to direct the bow string inwardly towards the user's body.

1 Claim, 5 Drawing Figures

BOW TRANSPORT HOLSTER

BACKGROUND OF THE INVENTION

1. Field of the Invention

This invention relates to archery devices and more particularly to a carrying device for quickly and releasably securing a bow to a user's body for transport.

2. Prior Art

In archery, both in hunting conditions and on the archery range, it is often desired to transport the bow while freeing the hands of the archer. Traditionally this has been done by slipping the bow string over the head and shoulder of the archer, however, this method is cumbersome, and in certain instances, particularly when using compound bows, is not practical.

Therefore, archers have heretofore often been faced with a difficulty in transporting an awkward bow while at the same time grasping other objects requiring both hands. Additionally, both in hunting and on ranges frequently the bow is not in use for protracted time periods and it would be an advantage to relieve the strain of carrying the bow in the hand for those time periods, particularly since some bows can be relatively heavy, without requiring that the bow be set aside.

SUMMARY OF THE INVENTION

My invention provides a simple quick attach — quick detach holster for bows comprising a body carried portion which is attachable to the user's belt and which is equipped with a first interlock means which slide interlocks with a second interlock means permanently affixed to the bow. The interlock means shown herein is of such a nature as to both attach the bow to the holster or body carried portion quickly and easily, provide a secure interlock, and at the same time not interfere with use of the bow when the bow is removed from the body carried holster portion.

Further, the interlock which I disclose herein has the distinct advantage of preventing the bow from tilting either in or out or forwardly and downwardly or backwardly and downwardly with respect to the holster which would otherwise occur due to the length of the bow.

In order to provide all of these features, I have chosen to use an interlock system wherein the body carried holster has a female slotted member with an elevated center including the slot which center is spaced from the holster base. A male T-headed member is attached to the bow with the cross bar of the T projecting from a base of the T-headed member a distance sufficient to allow the upright of the T to be slipped into the slot of the female member while at the same time being a short enough distance to not seriously interfere with the usage of the bow. Both the male and female members are of a length sufficient to prevent fore and back tilting of the bow when carried in the holster while the use of the slot and T head prevents in and out tilting.

In order to prevent the bow string, which is preferably carried in an up position under the arm of the user, from riding out and contacting or rubbing against the arm of the user, I have slanted the interlock members to tilt the bow and string inwardly towards the body of the user.

It is therefore an object of this invention to provide a bow transporting holster for use in archery.

It is a particular object of this invention to provide a bow transporting holster for use in archery including a wearer attachable member and a bow attached member, the members including indexable interlock means to allow selective attachment of the bow to the holster.

It is another and more particular object of this invention to provide a bow carrying holster including a wearer attachable holster portion having a female slotted interlock member and a bow carried male member quickly indexable with the female member to support the bow on the holster, the male and female members preventing tilting of the bow with respect to the holster and the members being angled with respect to the holster to bias the bow string to a position close to the user's body.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
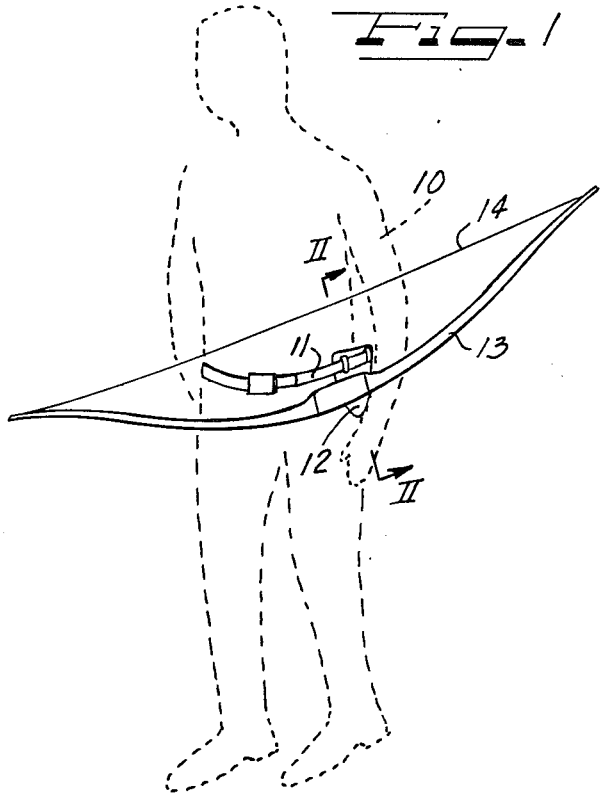
FIG. 1 is a perspective view of an archer wearing the bow holster of this invention having a bow attached thereto.
Figure 2:
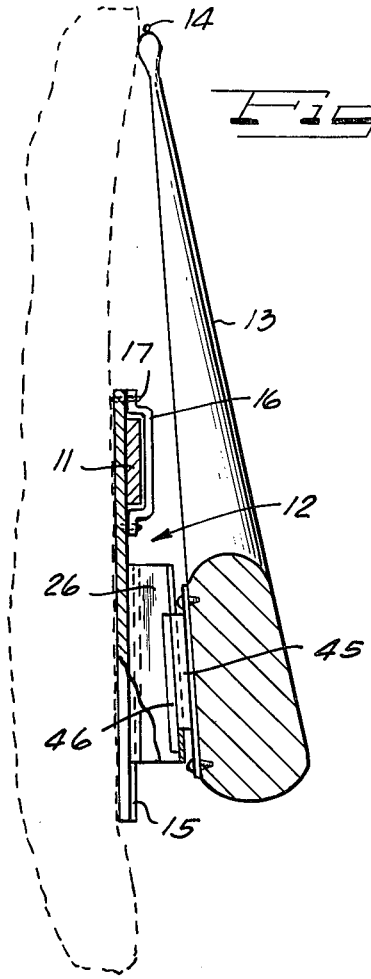
FIG. 2 is a fragmentary cross-sectional view taken along the lines II—II of FIG. 1.

FIG. 1 illustrates an archer wearing a belt 11 carried holster 12 supporting a bow 13 having a bow string 14. The holster 12 is, in the preferred embodiment, formed of a shield shaped piece of heavy leather 15 having belt loops 16 affixed thereto by means such as stitching 17. The belt loops are adjacent the top of the shield 15.

A slotted front pocket 20 is affixed to the shield adjacent the bottom thereof and may also be attached as by means of sewing 21 around the side and bottom periphery thereof. The slot 22 of the pocket 20 has an opening receiving the central portion 25 of a female interlock 26 with flange portions 27 of the interlock 26 lying between the pocket, which may be formed of leather, and the leather shield 15 thereby retaining the female interlock 26 in place. The female interlock 26 has a slot 28 in a central portion thereof which projects from the pocket through the pocket slot 22. The slot 28 is open to the top 29 of the interlock 26 and closed in spaced relation to the bottom 30 of the interlock.

Figure 3:
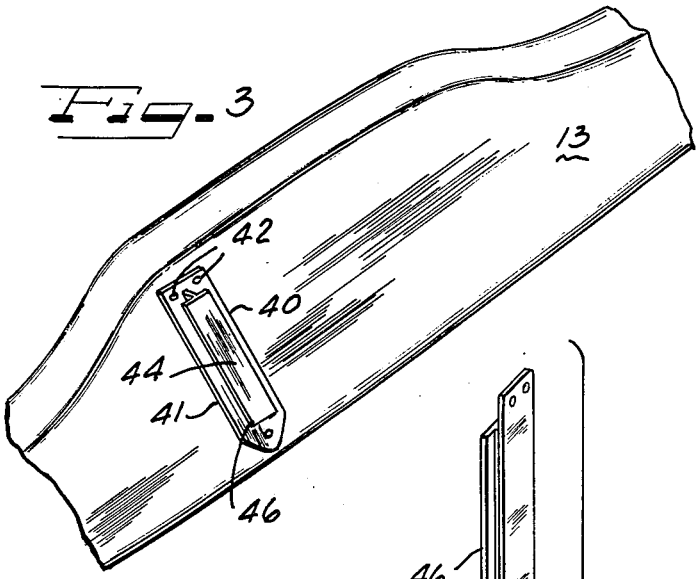
FIG. 3 is a perspective view of the bow attached male member of the interlock device of this invention.
Figure 4:
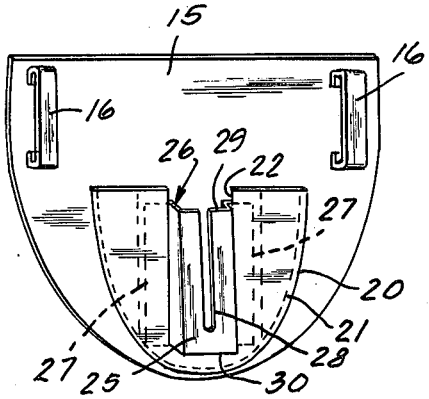
FIG. 4 is an elevational view of the wearer carried holster portion showing the female interlock member.
Figure 5:
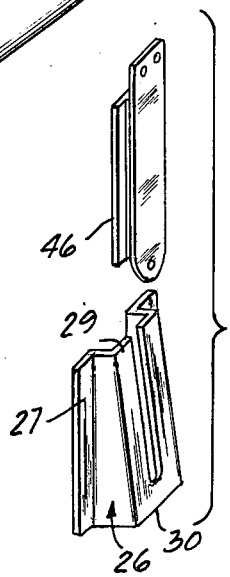
FIG. 5 is an exploded perspective view of the male and female interlock members of this invention.

As best illustrated in FIG. 3, a male interlock member 40 is attached to the bow 13 adjacent a balance point of the bow. The male interlock 40 includes a base portion 41 which may be fitted with screw or nail holes 42 for affixture to the bow. In other embodiments the male interlock 40 may be glued or otherwise bonded to the bow or a combination of gluing and mechanical fasteners may be used. A T-shaped projection 44 extends from the base 40 and includes an upright 45 extending outwardly from the base at a right angle thereto terminating in a cross head 46. The width of the cross head 46 and of the upright 45 are dimensioned with respect to the slot 28 to be indexable therewith with the base 40 overlying the front 25 of the central portion of the interlock 26 and the cross head 40 underlying the central portion 25 interior of the interlock 26. All dimensions are provided with clearance such as to allow easy insertion of the male interlock member into the slot 28.

It can thus be seen that, with the male member 40 attached to the bow and the female member carried by the holster, the bow can easily be affixed to and disengaged from the holster.

In order to insure that the string 14 will not rub against the inside of the arm 10 of the archer, the female interlock 26 is slanted as illustrated in FIG. 6 such that the top 29 lies closer to the flanges 27 than does the bottom 30. This will bias the string in towards the body of the archer.

Of course it is to be understood that the parts herein designated male and female can be reversed in their positioning on, respectively, the holster and bow.

The belt loops 16 are preferably spaced a distance sufficiently above the top of the female member in the pocket 20 as to allow free clearance of the male member without interference with the belt. Of course the belt loops can be placed on the other side of the shield if desired.

It can therefore be seen from the above that my invention provides a carrying holster for bows which allows an archer to clip a bow in place on a belt carried holster thereafter allowing transport of the bow without use of the hands. Due to the use of an elongated slot 28 and a long cross bar 26 tilting of the bow with respect to the holster is prevented and it is for this reason that I have herein shown, in the preferred embodiment, the particular male and female indexing members illustrated.

Although the teachings of my invention have herein been discussed with reference to specific theories and embodiments, it is to be understood that these are by way of illustration only and that others may wish to utilize my invention in different designs or applications.

I claim as my invention:

1. A bow holster comprising a base member, a first interlock member carried by said base member having a portion thereof in spaced relation to a surface of the base member, said portion having a top edge, the portion raised from and lying at an angle to said surface, a second interlock member adapted to be securely affixed to a bow transverse the length of the bow, said first and second interlock members being respectively female and male slot and head elongated members selectively indexable with one another providing a substantially secure joinder when indexed, the female slot being through the portion and open to the top edge of the portion, the angulation of the first member with respect to the base effective to angle the bow affixed to the second interlock member inwardly towards the body of an archer wearing the holster with the bow string maintained close to the body, means on the base member for attaching said base member to a belt of an archer using said holster.

* * * * *